US006295808B1

(12) United States Patent
Griffin et al.

(10) Patent No.: US 6,295,808 B1
(45) Date of Patent: Oct. 2, 2001

(54) HIGH DRIVEABILITY INDEX FUEL DETECTION BY EXHAUST GAS TEMPERATURE MEASUREMENT

(75) Inventors: Joseph R. Griffin; Todd Ferguson, both of Fenton, MI (US)

(73) Assignee: Hereaus Electro-Nite International N.V., Houthalen (BE)

( * ) Notice: Subject to any disclaimer, the term of this patent is extended or adjusted under 35 U.S.C. 154(b) by 0 days.

(21) Appl. No.: 09/533,264

(22) Filed: Mar. 20, 2000

Related U.S. Application Data

(60) Provisional application No. 60/141,390, filed on Jun. 29, 1999.

(51) Int. Cl.[7] ..... F01N 3/00

(52) U.S. Cl. ..... 60/285; 60/274; 60/284; 60/277

(58) Field of Search ..... 60/274, 277, 285, 60/284

(56) References Cited

U.S. PATENT DOCUMENTS

| | | | | |
|---|---|---|---|---|
| 4,656,829 | * | 4/1987 | Creps et al. | 60/277 |
| 5,303,168 | | 4/1994 | Cullen et al. . | |
| 5,414,994 | | 5/1995 | Cullen et al. . | |
| 5,426,934 | * | 6/1995 | Hunt et al. | 60/277 |
| 5,600,948 | * | 2/1997 | Nakajima et al. | 60/285 |
| 5,722,236 | | 3/1998 | Cullen et al. . | |
| 5,832,721 | | 11/1998 | Cullen . | |
| 5,896,743 | * | 4/1999 | Griffin | 60/277 |
| 6,032,753 | * | 3/2000 | Yamazaki et al. | 60/285 |
| 6,050,087 | * | 4/2000 | Kurihara et al. | 60/277 |
| 6,101,809 | * | 8/2000 | Ishizuka et al. | 60/285 |
| 6,164,064 | * | 12/2000 | Pott | 60/277 |
| 6,212,880 | * | 4/2001 | Takano et al. | 60/285 |

* cited by examiner

*Primary Examiner*—Thomas Denion
*Assistant Examiner*—Diem Tran
(74) *Attorney, Agent, or Firm*—Akin, Gump, Strauss, Hauer & Feld, L.L.P.

(57) ABSTRACT

A method for determining if the driveability index of a fuel being consumed by an internal combustion engine differs from the driveability index of a fuel for which the air-to-fuel ratio of the engine is preset. The method includes the steps of: determining the speed of the engine; determining the load on the engine; determining the actual exhaust gas temperature of the engine; and computing a predicted exhaust gas temperature based on the speed, the load and the preset air-to-fuel ratio of the engine. The actual exhaust gas temperature is compared to the predicted exhaust gas temperature to determine if the difference between the actual exhaust gas temperature and the predicted exhaust gas temperature exceeds a predetermined value.

15 Claims, 9 Drawing Sheets

HIGH DRIVEABILITY INDEX FUEL DETECTION BY EXHAUST GAS TEMPERATURE MEASUREMENT

CROSS REFERENCE TO RELATED APPLICATIONS

This application claims the benefit of U.S. Provisional Application No. 60/141,390, filed Jun. 29, 1999, entitled High Driveability Index Fuel Detection by Exhaust Gas Temperature Measurement.

BACKGROUND OF THE INVENTION

The present invention relates to emission control systems and more particularly, an emission control system for adjusting the air-to-fuel ratio of an internal combustion engine based upon a measurement of the exhaust gas temperature of the engine.

There are many new technologies being developed and existing technologies being refined to meet ever more stringent automotive exhaust emission standards. The two general areas of development for reducing automotive exhaust emissions are: (1) reducing engine generated exhaust emissions and (2) optimizing after-treatment of engine generated exhaust emissions.

Automotive tail pipe emissions are conventionally minimized by closed loop control of engine air and fuel by way of feedback from an exhaust gas oxygen (EGO) sensor mounted in the engine exhaust path. The EGO sensor output signal regulates the engine air-to-fuel (A/F) ratio by adjusting the engine fuel injection period for each cylinder event. A system of one or more three-way catalytic converters for after treatment of exhaust gases in combination with closed loop A/F ratio control provides a substantial reduction of tail pipe emissions.

However, neither the EGO sensor or the catalytic converter are immediately effective when a cold engine is first started. Catalytic converters must attain a critical temperature (i.e. the light-off temperature) before they are operative. The period of time prior to catalytic converter light-off is known as the cold start period and generally lasts about 30 seconds. Similarly, EGO sensors are electrically heated and require 10–15 seconds before the EGO sensor output can be used for closed loop control of the A/F ratio. Because EGO sensors require a warm-up time, and because a 10–15 second wait between ignition activation and the start of cranking is generally thought to be unacceptable to drivers, the control of automotive engines is preset to operate open loop, without benefit of EGO sensor feedback, for the first 10–15 seconds of operation. Thus the fuel injector periods are preset to achieve a predetermined A/F ratio based on assumed engine and fuel parameters during the cold start period.

The actual A/F ratio in an engine combustion chamber is a function of the volatility of the fuel. Fuel having a lower volatility results in a higher A/F ratio within the combustion chamber than higher volatility fuel. The volatility of fuel is characterized by a parameter referred to as the driveability index (DI) (see FIG. 1). The higher the driveability index, the lower is the volatility of the fuel. The DI of manufactured gasoline varies with grade and season, the normal range being from 850 to 1300. Further, the DI of the fuel delivered to an engine may vary due to evaporation. Thus, the DI of the fuel actually supplied to an engine cannot be accurately predetermined.

During warm engine operation, the output signal from the EGO sensor is effective to compensate for the variable DI of the fuel. However, as shown in FIG. 2, during the cold start period of internal combustion engine operation, when the EGO sensor is inactive and the regulation of A/F ratio is open loop, fuel having a high DI (curve A) causes the A/F ratio of fuel in the engine combustion chamber to shift in the lean direction compared to standard DI fuel (curve B), resulting in unacceptable vehicle driveability, i.e. hard starting, rough idle, poor throttle response and stalling. In order to compensate for the lean shift of the A/F ratio during the cold start period caused by high DI fuel, the open loop A/F ratio of automotive engines is generally preset to be richer than for standard fuel (i.e. DI=1100) to provide acceptable vehicle driveability in the event that the fuel supply has a high DI (i.e. DI=1275). The result is that when standard driveability fuel is in use, the A/F ratio is too rich, undesirably increasing hydrocarbon (HC) emissions. Since it is likely that the DI of the fuel is standard, and since up to 80% of automotive HC tail pipe emissions under federal test procedure FTP 75 occur during the cold start period, the increase in HC emissions due to unnecessarily compensating for the unlikely presence of high DI fuel is significant.

If the DI of the fuel could be quickly determined, it would not be necessary to program the A/F ratio to be overly rich. Experimental data demonstrates that the temperature of the exhaust gas of an internal combustion engine is a function of the A/F ratio (see FIG. 3). Furthermore, computer models currently in use in existing engine control systems can predict the temperature of the exhaust gas with acceptable accuracy when provided with information on engine speed, engine load, A/F ratio and engine timing. Consequently, the presence of high DI gasoline is capable of being detected by measuring the temperature of the exhaust gas of an internal combustion engine and comparing the measured exhaust gas temperature with the temperature that would be produced by standard DI gasoline as predicted by the exhaust gas temperature prediction model. FIG. 4 shows experimental data that demonstrates a measurable difference in exhaust gas temperature at the beginning of the cold start period when high DI fuel (curve A) is used, compared to the exhaust gas temperature resulting from using standard fuel (curve B).

The present invention, by initially setting the engine A/F ratio for standard DI fuel, optimizes the operation of the engine by providing acceptable vehicle driveability with reduced HC emission during the cold start period, compared to the conventional method of initially enriching the A/F ratio on the chance that the fuel may have a high DI. The present invention uses an empirically derived computer model to provide a prediction of the exhaust gas temperature that results from using standard DI fuel. As the engine warms up, the actual exhaust gas temperature is measured with a fast response time exhaust gas temperature sensor and compared with the predicted exhaust gas temperature. If the actual exhaust gas temperature is higher than the temperature predicted by the computer model, high DI fuel is indicated. Accordingly, upon detecting the high DI fuel, the A/F ratio is made richer in proportion to the temperature difference between the predicted and actual values of the exhaust gas temperature.

BRIEF SUMMARY OF THE INVENTION

In brief, the present invention comprises a method for determining if the driveability index of a first fuel being consumed by an internal combustion engine differs from the driveability index of a second fuel for which an air-to-fuel ratio of the engine is preset, the method comprising the steps of: determining a speed of the engine; determining a load on the engine; determining an actual exhaust gas temperature of the engine; computing a predicted exhaust gas temperature based on the speed, the load and the preset air-to-fuel ratio of the engine; and comparing the predicted exhaust gas temperature to the actual exhaust gas temperature to determine if the difference between the actual exhaust gas temperature and the predicted exhaust gas temperature exceeds a predetermined value.

The present invention also comprises a system for determining if the driveability index of a first fuel being consumed by an internal combustion engine differs from the driveability index of a second fuel for which the air-to-fuel ratio of the engine is preset, the system comprising: a sensor for measuring the speed of the engine; a sensor for measuring the load on the engine; a sensor for measuring the actual exhaust gas temperature of the engine; and a controller for receiving output signals from the speed sensor, the load sensor and the exhaust gas temperature sensor, computing a predicted exhaust gas temperature based on the sensed speed, the sensed load and the preset air-to-fuel ratio of the engine, and comparing the predicted exhaust gas temperature to the actual exhaust gas temperature to determine if the difference between the actual exhaust gas temperature and the predicted exhaust gas temperature exceeds a predetermined value.

The present invention also includes a method for optimizing an air-to-fuel ratio of an internal combustion engine to achieve satisfactory driveability during a cold start period, when the engine is being supplied with a first fuel having an unknown driveability index, comprising the steps of: presetting an air-to-fuel ratio of the engine to a predetermined value to achieve satisfactory driveability with a second fuel having a predetermined driveability index; determining a speed of the engine; determining a load of the engine; determining an actual exhaust gas temperature of the engine; and computing a predicted exhaust gas temperature based upon the speed of the engine, the load of the engine, and the preset air-to-fuel ratio; comparing the predicted exhaust gas temperature and the actual exhaust gas temperature; and correcting the preset air-to-fuel ratio in proportion to a difference between the predicted exhaust gas temperature and the actual exhaust gas temperature.

The present invention also includes a system for optimizing an air-to-fuel ratio of an internal combustion engine during a cold start period when the engine is being supplied with a first fuel having an unknown driveability index comprising: a sensor for measuring a speed of the engine; a sensor for measuring a load of the engine; a sensor for measuring an actual exhaust gas temperature of the engine; and a controller for receiving output signals from the speed sensor, the load sensor and the exhaust gas temperature sensor, for predicting the exhaust gas temperature resulting from the engine being supplied with a second fuel having a predetermined driveability index, the predicted exhaust gas temperature being based on the sensed speed, the sensed load, and a preset air-to-fuel ratio of the engine, for comparing the actual exhaust gas temperature with the predicted exhaust gas temperature and for providing an output signal to at least one actuator for correcting the preset air-to-fuel ratio in relation to a difference between the predicted exhaust gas temperature and the actual exhaust gas temperature.

The present invention also includes a method for reducing hydrocarbon emissions from an internal combustion engine during a cold start period, comprising the steps of: determining if the internal combustion engine is cold; predicting a temperature of an exhaust gas of the engine based on an air-to-fuel ratio of the engine, a speed of the engine and a load of the engine, the air-to-fuel ratio being selected for a fuel having a predetermined driveability index; sensing an actual temperature of the exhaust gas; comparing the predicted exhaust gas temperature with the actual exhaust gas temperature; and correcting the air-to-fuel ratio of the engine in proportion to the difference between the predicted exhaust gas temperature and the sensed exhaust gas temperature.

Finally, the present invention also includes a computer executable software code stored on a computer readable medium, the code for reducing the hydrocarbon emissions of an internal combustion engine during a cold start period, the software comprising: code initially setting an air-to-fuel ratio of the engine to a preset value; a plurality of empirically derived look-up tables, each look-up table providing a single value of exhaust gas temperature for a given value of the preset air-to-fuel ratio, wherein each look-up table covers a predetermined range of a sensed speed of the engine and a sensed load of the engine; code responsive to receiving a value of the sensed engine load; code responsive to receiving a value of the sensed engine speed; code for selecting one of the look-up tables corresponding to the sensed engine speed and the sensed engine load; code for receiving the preset air-to-fuel ratio in the selected look-up table and identifying a predicted exhaust gas temperature; code responsive to receiving a value of a sensed exhaust gas temperature; and code for comparing the predicted exhaust gas temperature with the sensed exhaust gas temperature and for correcting the preset air-to-fuel ratio of the engine in proportion to the difference between the predicted exhaust gas temperature and the sensed exhaust gas temperature.

DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
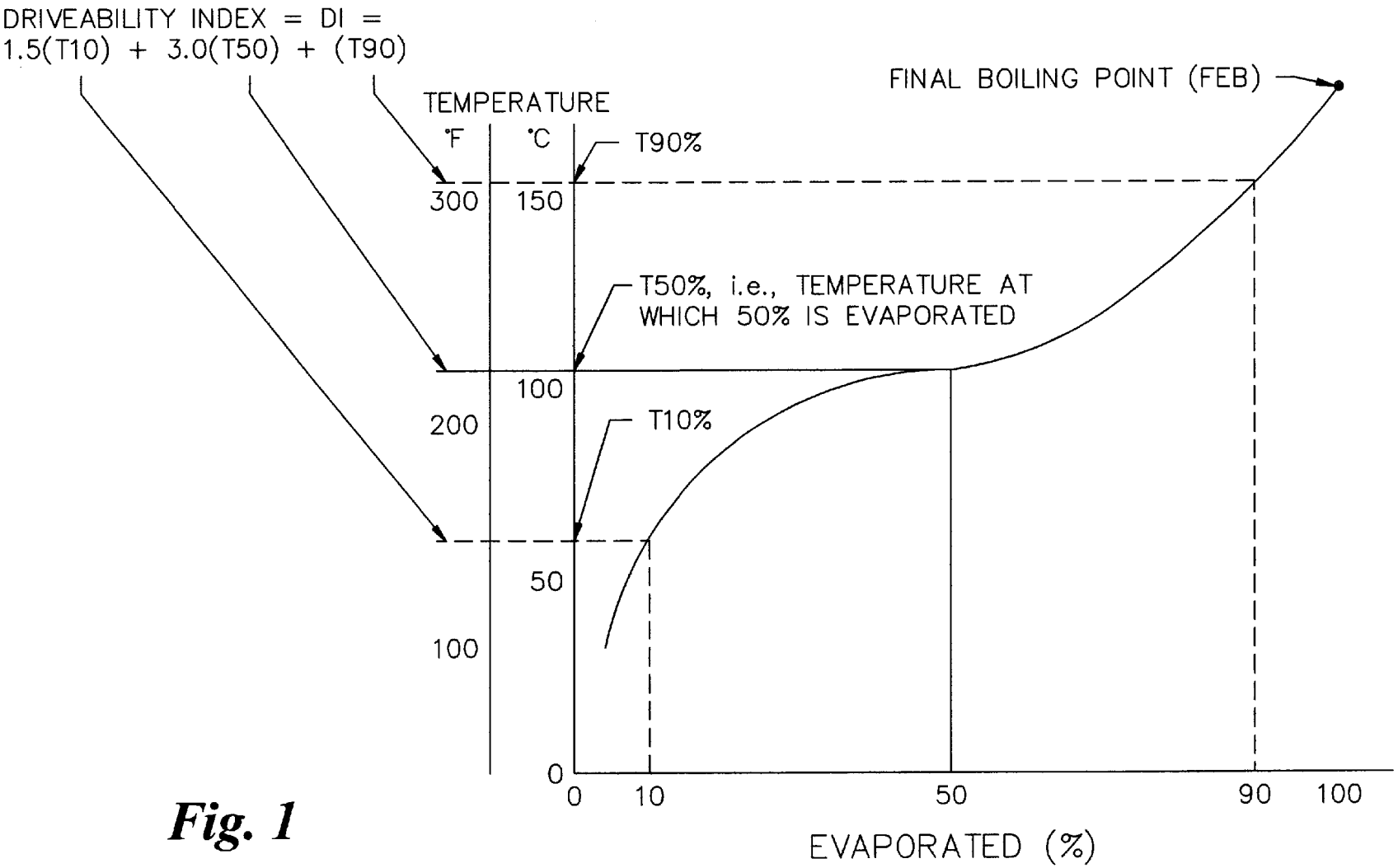
FIG. 1 is a graph showing the relationship of driveability index to percent fuel evaporation.
Figure 2:
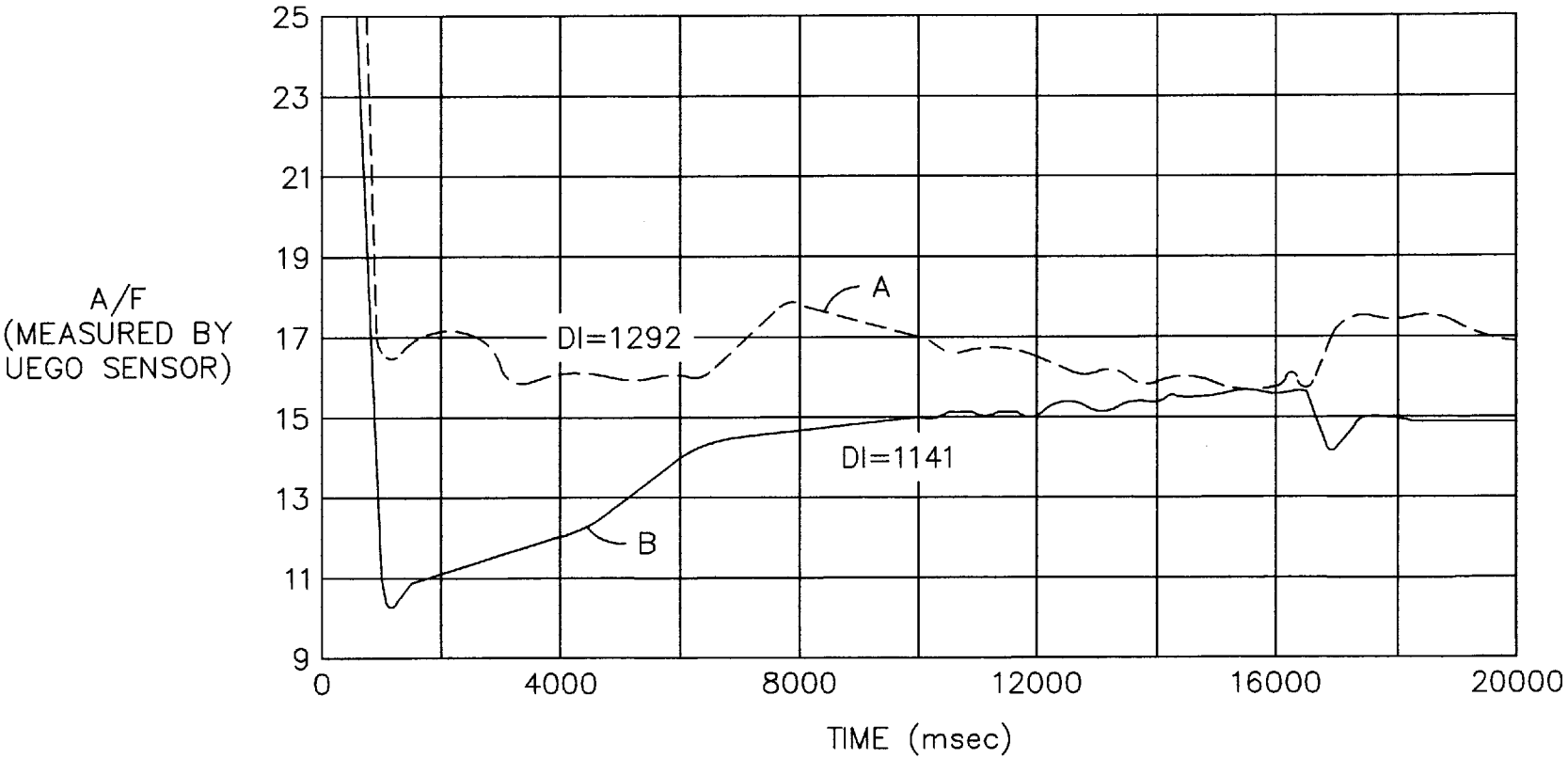
FIG. 2 is a graph of experimental data illustrating the A/F ratio resulting from the use of fuels having a DI of 1292 and 1141 respectively.
Figure 3:
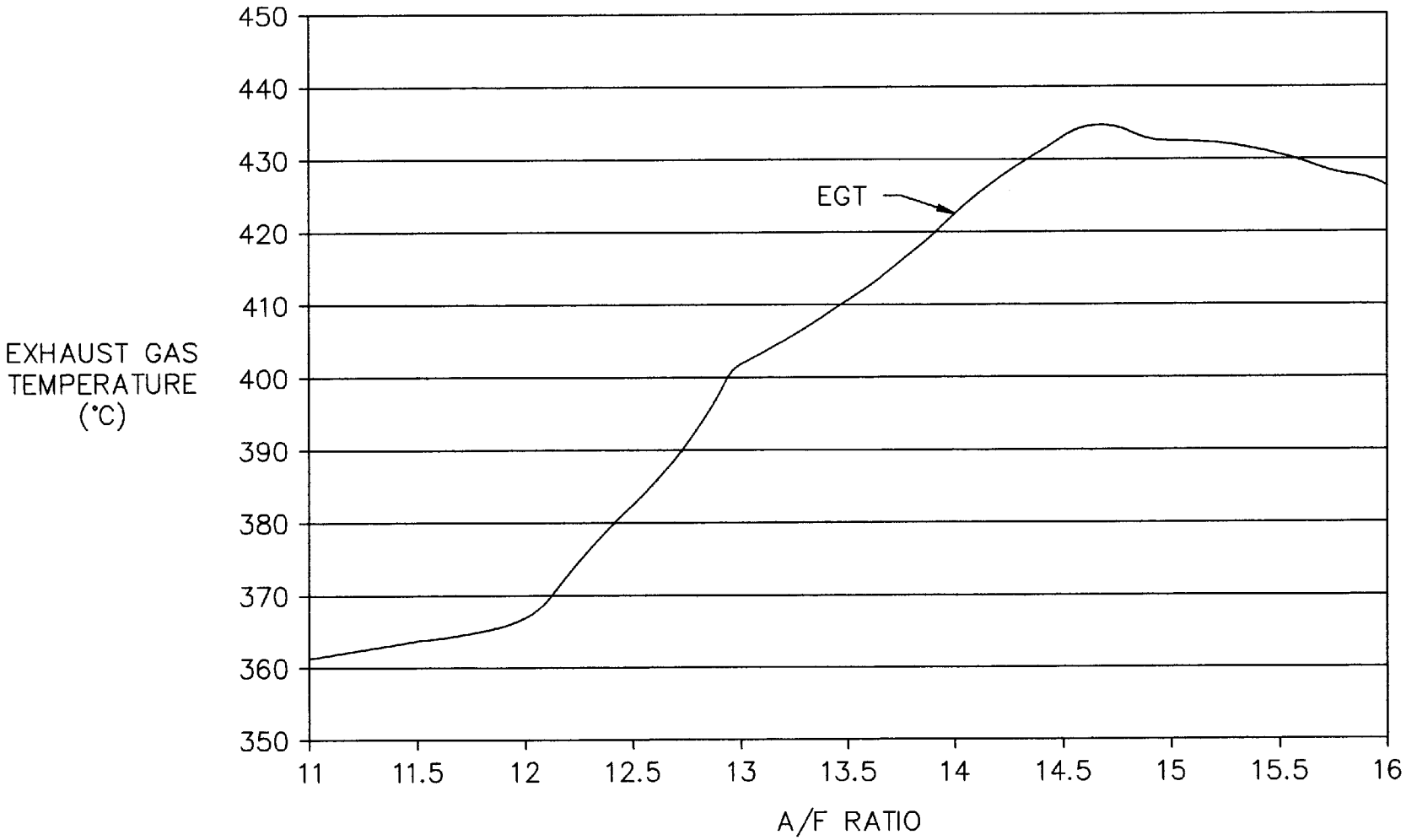
FIG. 3 is a graph of experimental data illustrating the relationship between A/F ratio and exhaust gas temperature.
Figure 4:
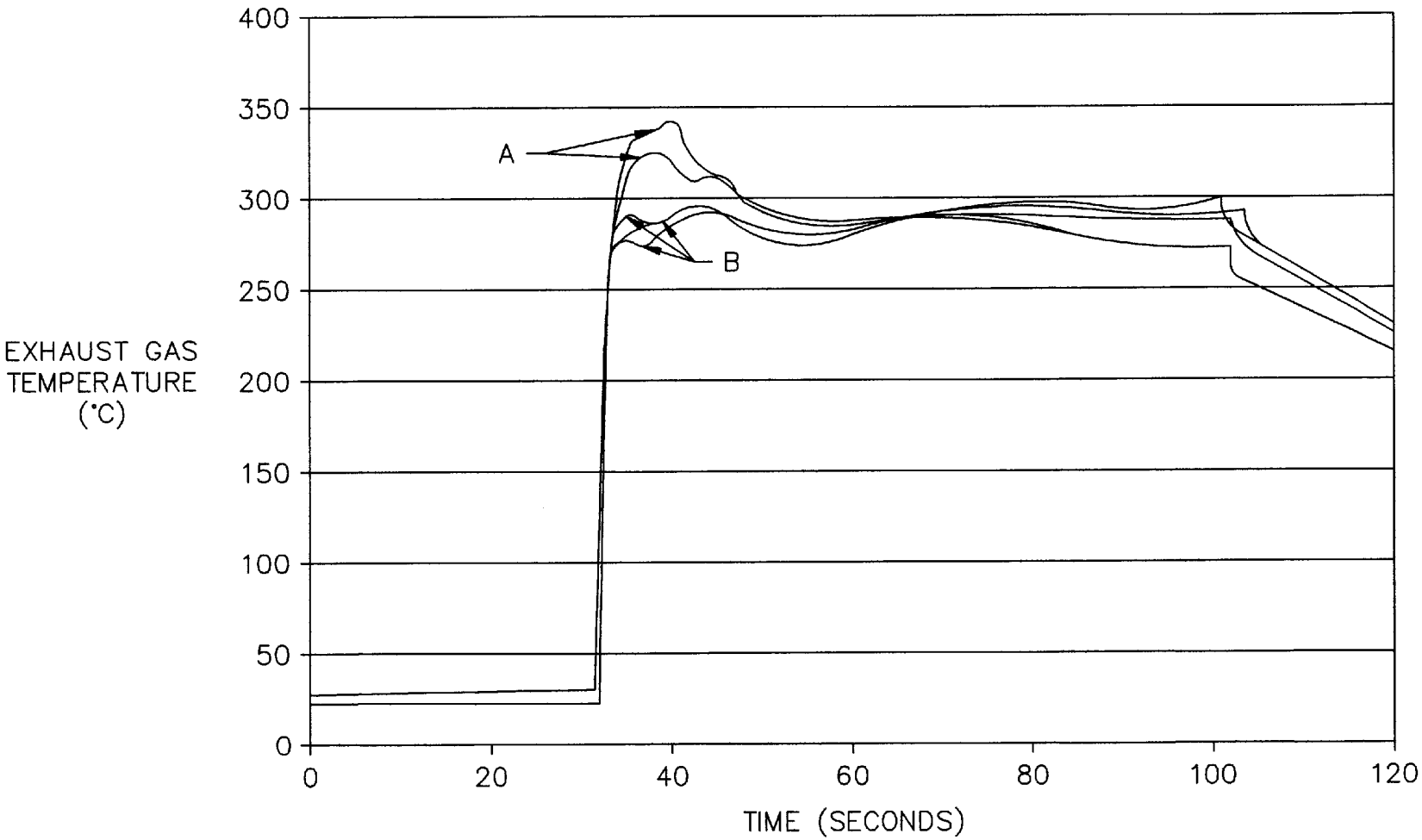
FIG. 4 is a graph of experimental data illustrating the difference in exhaust gas temperature that results from the use of high and low DI fuel respectively.

Referring to the drawings, where like numerals are used to indicate like elements throughout there is shown in FIG.

5*a*, a schematic block diagram of a typical modern internal combustion engine control system 10 including an engine 14 that is supplied with air and fuel. The air and fuel undergo combustion in the engine 14 and the exhaust gases resulting from the combustion are exhausted by the engine 14 into the exhaust system 34 and subsequently to the atmosphere through a catalytic converter 16 and tailpipe 36. The catalytic converter 16 typically takes the form of a conventional three-way catalytic converter that is effective to simultaneously convert hydrocarbons (HC), nitrogen oxides ($NO_x$) and carbon monoxide (CO) to water ($H_2O$), carbon dioxide ($CO_2$) and nitrogen ($N_2$) when the air/fuel (A/F) ratio of the mixture of air and fuel supplied to the engine 14 is substantially stoichiometric, i.e. the A/F ratio equals 14.7 and the temperature of the catalytic converter 16 is sufficiently high to start the catalytic process, (the light-off temperature).

In the typical engine control system 10, the desired A/F ratio is controlled by an engine control module 12. The engine control module 12 accepts inputs from an RPM sensor 30 for determining a speed of the engine, a mass air flow (MAF) sensor 28 for determining a load to the engine 14, an engine coolant temperature (ECT) sensor 26 for determining a temperature of the engine 14, an air charge temperature (ACT) sensor 24 for determining a temperature of the intake air of the engine 14, and an exhaust gas oxygen (EGO) sensor 18 for determining the correct A/F ratio in the engine 14. The engine control module 12 also receives crankshaft position and cylinder identification input signals. The aforementioned input signals are used by the engine control module 12 to control engine actuators 32 that control the engine 14 air-to-fuel ratio, spark timing and idle-air bypass to improve driveability and to control exhaust emissions with little sacrifice of power. The construction and operation of the typical engine control system 10, the sensors 18, 24, 26, 28, 30, the actuators 32 and the engine control module 12 are well known to those skilled in the art and need not be described in detail for a full understanding of the present invention.

As indicated above, the engine control system 10 is effective for reducing emissions when the catalytic converter 16 reaches the light-off temperature. The period of time from the time a cold engine starts to the time the catalytic converter 16 reaches the light-off temperature is commonly referred to as the cold start period. During the cold start period, the catalytic converter 16 is ineffective in reducing emissions. Further, closed loop regulation of A/F ratio is not feasible because the EGO sensor does not become active for 10–15 seconds after the engine ignition is actuated. Accordingly, control of the engine 14 is open loop during the cold start period. Since the driveability index of the fuel supplied to the engine 14 is variable and generally unknown, it is not currently possible to properly adjust the A/F ratio of the engine 14 during the cold start period to account for the unknown DI index of the fuel and thus to minimize emissions during the cold start period.

Figure 5A:
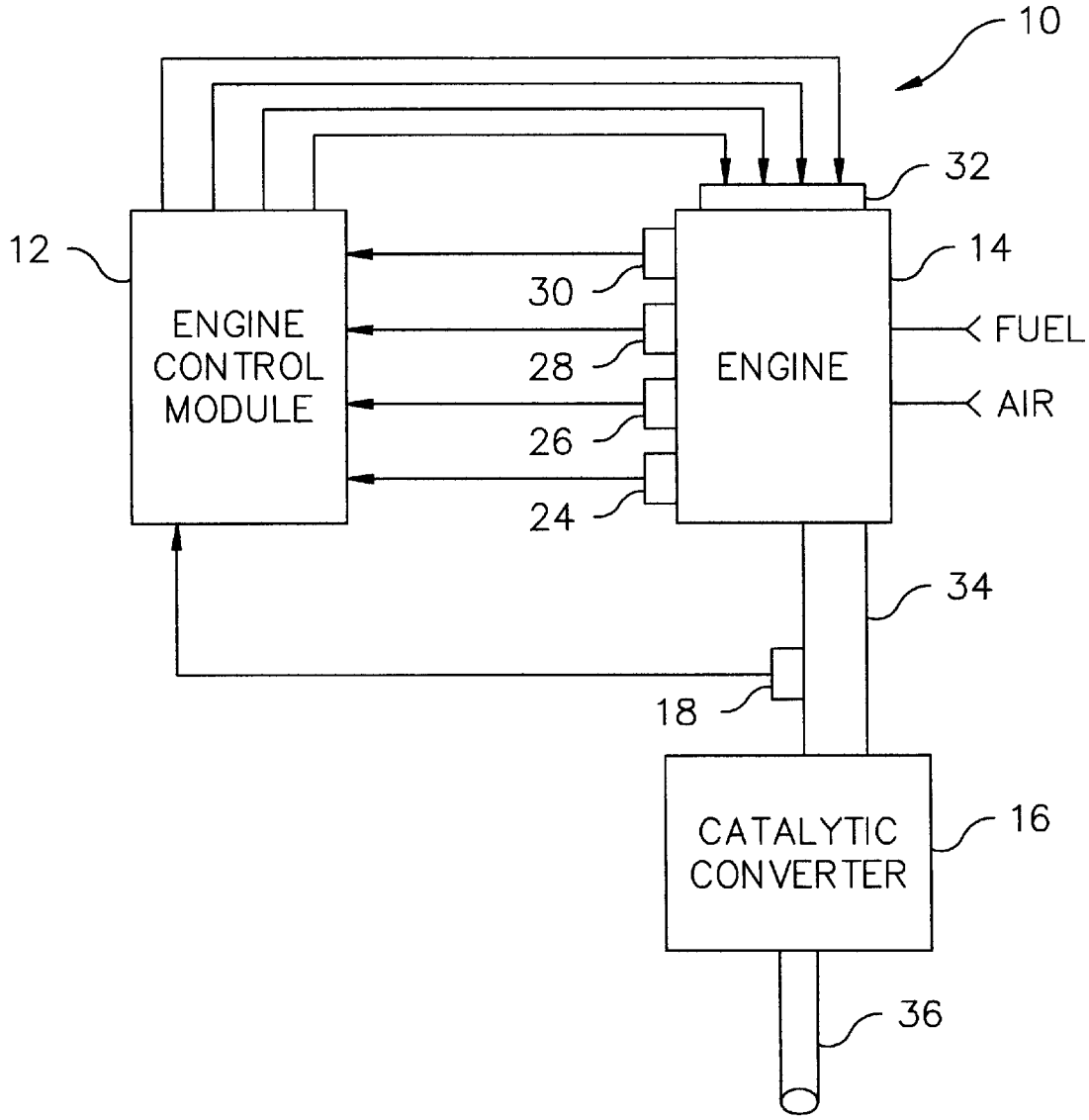
Fig. 5a (Prior Art)
FIG. 5*a* is a schematic block diagram of a typical internal combustion engine control system.
Figure 5B:
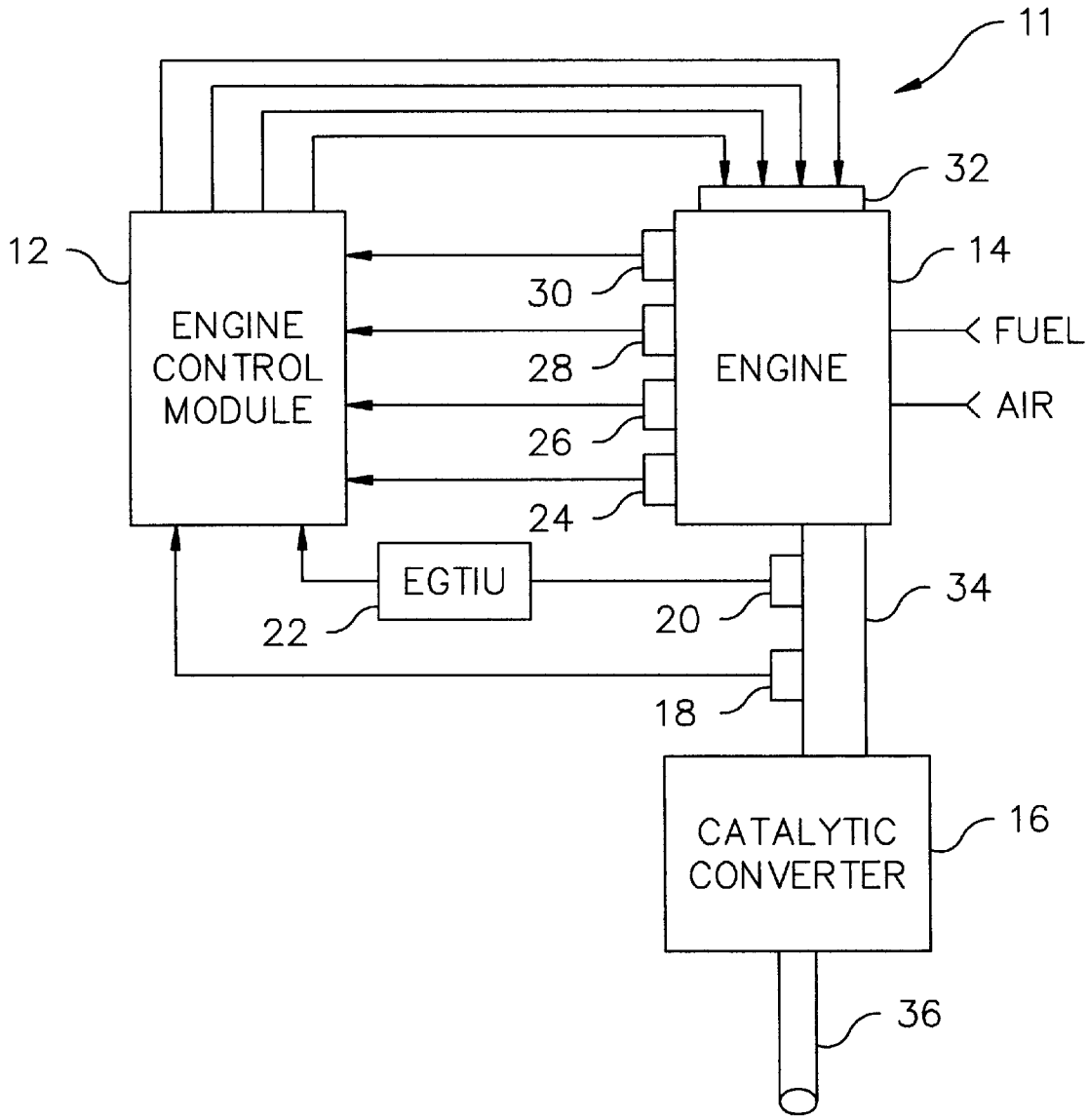
FIG. 5*b* is schematic block diagram of a preferred embodiment of a system for optimizing the A/F ratio of an internal combustion engine according to the present invention.

FIG. 5*b* is schematic block diagram of a preferred embodiment of a system 11 for optimizing the A/F ratio of an internal combustion engine 14 during a cold start period when the engine 14 is consuming fuel having an unknown driveability index. The preferred embodiment of the system 11 includes the elements described above which are found in a typical modem day internal combustion engine control system 10 with the addition of a fast response exhaust gas temperature (EGT) sensor 20 and an EGT response enhancement interface unit (EGTIU) 22. The EGT sensor 20 is engaged with or is coupled to the exhaust system 34 for sensing the exhaust gas temperature of the engine 14 and continuously generating an electrical temperature output signal which is proportional to or representative of the instantaneous exhaust gas temperature. In the preferred embodiment, the temperature sensor 20 is a Heraeus Sensor-Nite Model Number ECO-TS200s platinum resistive temperature detector (RTD) sensor, which provides for a substantially linear change in resistance over a sensed temperature range of from 0 to 1,000° C. As will be appreciated by those skilled in the art, other types of temperature sensors from other manufacturers having suitable accuracy, stability and reliability could be used as the fast response EGT sensor 20, within the spirit and scope of the invention.

The preferred embodiment of the control system 11 also includes an EGTIU 22 for receiving an output signal from the EGT sensor 20 and for processing the EGT sensor output signal to provide an improved response time which preferably is less than one second. In the preferred embodiment, the temperature sensor 20 has a response time of about 5+/−0.1 seconds to a 300 degree C. step change of exhaust gas temperature at a gas velocity of 11 meters per second. The EGTIU 22 enhances the response time of the EGT temperature sensor 20 by processing the output signal of the EGT sensor 20 by an empirical software model of a small dimension thermocouple (not shown in FIG. 5*b*). The resulting effective response time of the combination of the EGT sensor 20 and EGTIU 22 is about one second. As will be apparent to those skilled in the art, the more rapid the effective rise time of the EGT sensor output, the more faithful will be the control of the engine 12. However, the present invention is not limited to an effective rise time of the EGT sensor 20 of one second. The choice of an effective rise time value consistent with satisfactory control dynamics for a particular engine 14 is within the spirit and scope of the invention.

Figure 6:
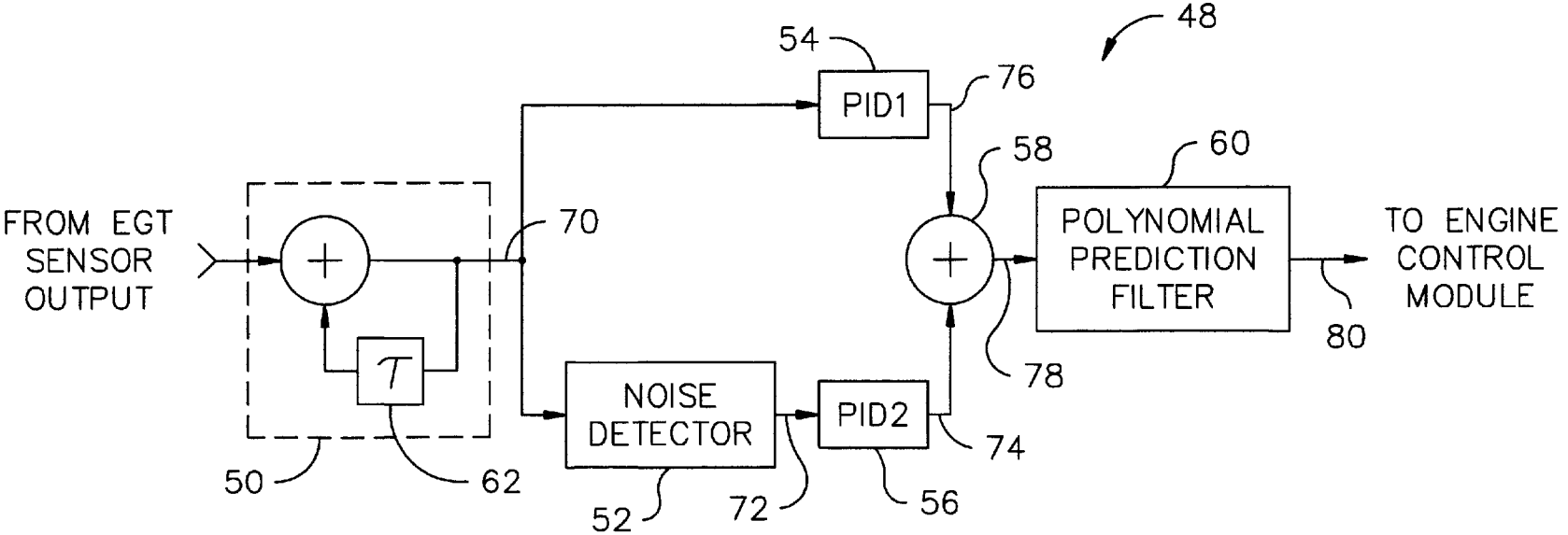
FIG. 6 is a schematic block diagram of a small dimension thermocouple model.

Referring now to FIG. 6, there is shown a functional block diagram of the small dimension thermocouple model 48 as implemented in software in the EGTIU 22. In use, the output signal of the EGT sensor 20 is first applied to an analog-to-digital converter (not shown) in the EGTIU 22 and sampled at a rate of about 100 samples per second. The sampled output signal from the EGT sensor 20 is then applied to the small dimension thermocouple model 48 and is processed first in a recursive filter 50 having a unit delay feedback element 62 providing a low pass filter function. The recursive filter output 70 is then applied to both a noise detector 52 and to a first proportional-integral-differential (PID1) controller function 54. The noise detector 52 detects signals which change at rates exceeding the equivalent of 200 degrees C. to eliminate non-physical signals due to noise pickup or malfunctions and to thereby prevent such signals from corrupting the output 80 of the small dimension thermocouple model 48. The output 72 from the noise detector 52 is applied to a second proportional-integral-differential (PID2) controller function 56. The output 74 of PID2 56 is added to the output 76 of PID1 in a summer 58. PID1 54 and PID2 56 are controller functions well known to those skilled in the art of control theory, providing adjustable phase lead, phase lag and gain, and are adjusted to provide control stability to the system 10 when interoperating with the actuators 32 of the engine 14. The output 78 of the summer 58 is applied to a polynomial prediction filter 60. The polynomial prediction filter 60 is modeled on a temperature sensor having a 500 millisecond response to a 300 degree step in temperature. The modeling of sensor responses with polynomial prediction filters is well known to those skilled in the art and need not be described in detail for a full understanding of the present invention. Although in the preferred embodiment the small dimension thermocouple model 48 is shown implemented in the EGTIU 22, the small dimension thermocouple model 48 need not be implemented in a physically separate unit. As will be appreciated by those skilled in the art, the small dimension thermocouple model 48, used to enhance the response time of the EGT sensor 20, could be integrated with other units such as the engine control module 12 and still be within the spirit and scope of the invention.

In the preferred embodiment the engine control module 12 receives the output signals from the speed sensor 30 and the exhaust gas temperature sensor 20 for predicting the exhaust gas temperature resulting from the engine 14 having a preset A/F ratio and using a fuel having a predetermined driveability index. In U.S. Pat. No. 4,656,829, the temperature of a catalytic converter is predicted by empirically determined steady state temperature contributions to the catalytic converter from the mass air flow through the engine and the A/F ratio of the mixture supplied to the engine. In U.S. Pat. No. 5,303,168 the engine exhaust gas temperature is predicted by models based on engine speed, engine load, ignition timing, exhaust gas recirculation percent and A/F ratio. The aforementioned prediction models are suggested as being useful for predicting if the temperature in the exhaust system 34 or catalytic converter 16 exceeds a predetermined value under nominally steady state conditions.

Figure 7:
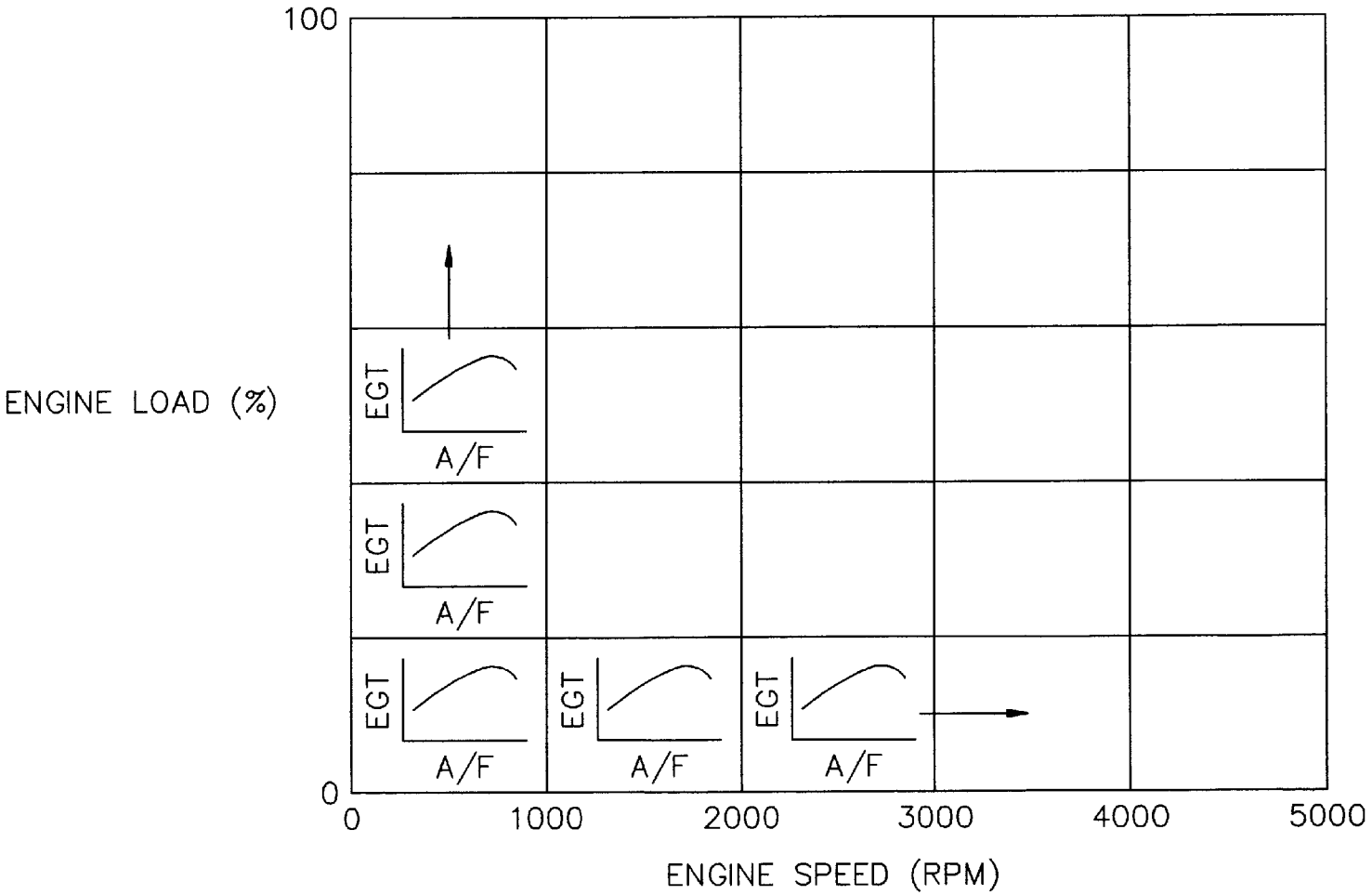
FIG. 7 is a diagram illustrating an exhaust gas temperature prediction model.

In the preferred embodiment, empirically derived look-up tables, shown diagrammatically in FIG. 7, are incorporated in read only memory in the engine control module 12 for predicting the exhaust gas temperature of the engine 14 during the cold start based on the preset open loop A/F ratio of the engine 14 and a predetermined driveability index of the fuel. As shown in FIG. 7, there are a plurality of look-up tables, each look-up table covering a predetermined range of the speed of the engine 14 and the load of the engine 14. As will be appreciated by those skilled in the art, the prediction model may take other forms than empirical look-up tables. For example, the prediction model may be a combination of tables and formulas, or entirely in formula form and still be within the spirit and scope of the invention.

In the preferred embodiment the exhaust gas temperature predicted by the prediction model is compared with the actual exhaust gas temperature determined from the output of the EGT sensor 20 through the EGTIU 22 to determine if the difference between the actual exhaust gas temperature as determined by the EGT sensor 20 and the predicted exhaust gas temperature exceeds a certain predetermined value. In the preferred embodiment, the A/F ratio is preset for standard driveability index fuel, which has a lower driveability index than high driveability index fuel. Accordingly, the A/F ratio is preset to be leaner than is generally preset in current engine control systems 10, which expressly program a richer A/F ratio to ensure satisfactory vehicle driveability if the driveability index of the fuel happens to be higher than standard. Programming the A/F ratio leaner results in reduced HC and CO emissions during the cold start period compared to the richer preset A/F ratio. When the actual exhaust gas temperature measured by the EGT sensor 20 exceeds the predicted exhaust gas temperature by the predetermined amount, it is an indication that high driveability fuel is being supplied to the engine 14. In this case, the engine control module 12 commands a richer A/F ratio in proportion to the difference between the actual exhaust gas temperature and the predicted exhaust gas temperature to ensure vehicle driveability. As will be appreciated by those skilled in the art, the A/F ratio need not be initially preset for standard driveability fuel. It would be considered to be within the spirit and scope of the invention if the A/F ratio were initially preset for high driveability fuel and the A/F ratio made leaner if the actual exhaust gas temperature was determined to be less than the predicted exhaust gas temperature.

Figure 8:
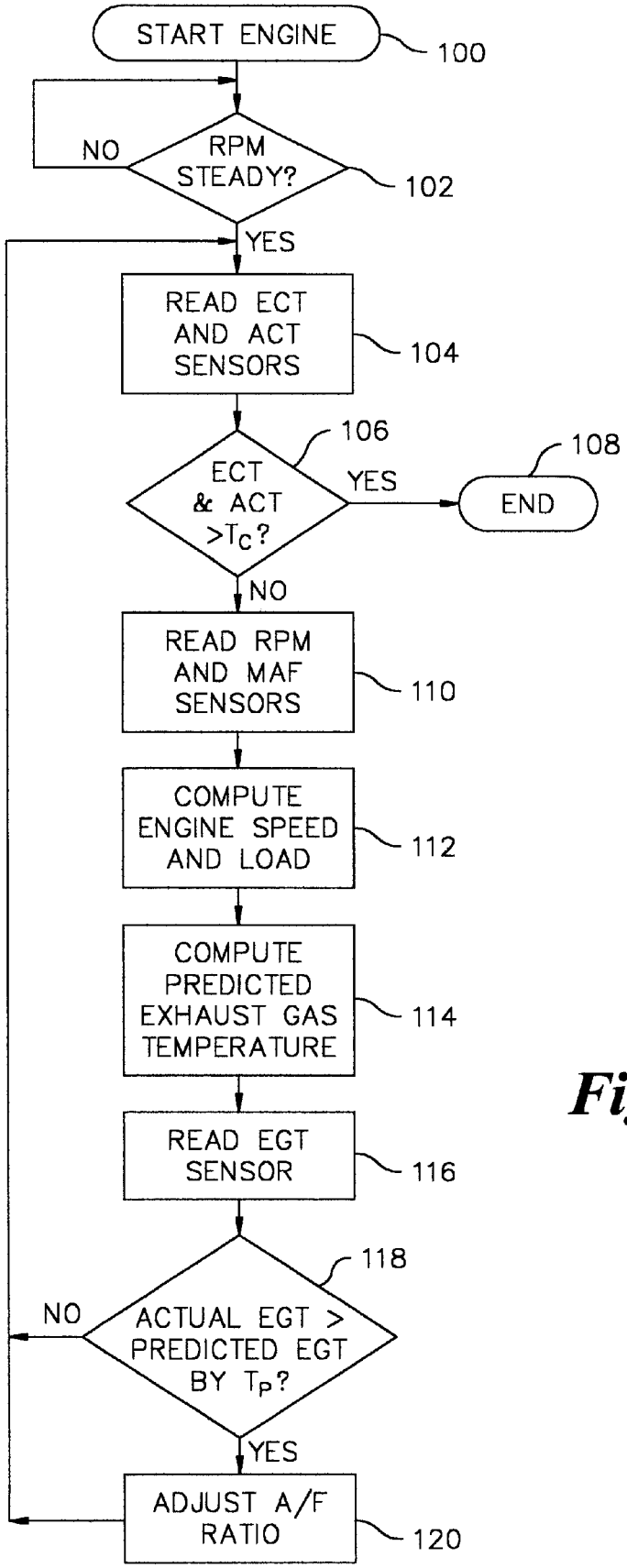
FIG. 8 is a flow diagram of a preferred method for reducing hydrocarbon emissions from an internal combustion engine.

Referring now to FIG. 8 there is shown a flow diagram of a preferred method for reducing the HC emissions from an internal combustion engine during a cold start period in accordance with the present invention. Subsequent to activating the ignition of the engine 14 at step 100, the output from the RPM sensor 30 is evaluated to determine if the engine is running steadily. If the engine 14 is determined to be running, the outputs of the ECT sensor 26 and the ACT sensors 24 are evaluated (step 104) to determine the engine coolant temperature and the intake air temperature respectively. If both the engine coolant temperature and the air charge temperature are less than a predetermined temperature, Tc, typically 75 degrees F., the engine 14 is considered to be in a cold start state (step 106). The outputs from the RPM sensor 30, and the MAF sensor 28 are now evaluated (step 110) and the speed of the engine 14 and the load on the engine 14 are computed at step 112. The predicted exhaust gas temperature is then computed at step 114 by addressing the specific look-up table stored in the engine controller 12, corresponding to the speed and the load of the engine 14, with the preset A/F ratio. The predicted exhaust gas temperature is then compared with the actual exhaust gas temperature determined from the output of the EGTIU 22. At step 120, the A/F ratio is adjusted either up or down depending upon the initially preset value of the A/F ratio, the magnitude of the A/F ratio adjustment being proportional to the difference between the actual and predicted values of the exhaust gas temperature. In the preferred embodiment, the cycle of measuring the outputs of the sensors 20, 22, 24, 26, 28, 30, computing the predicted exhaust gas temperature, and adjusting the A/F ratio based on comparing the exhaust gas temperature with the predicted exhaust gas temperature continues at intervals of about 0.1 second until either the air intake temperature or the engine coolant temperature is greater than the predetermined temperature threshold, Tc, or the EGO sensor 18 is activated by the engine controller 12 to assume closed loop control of the A/F ratio.

In the preferred embodiment, a computer program resides in the engine control module 12 for executing the aforementioned method for detecting the presence of fuel having a driveability index different from the driveability index for which the engine control module 12 is preset during the cold start period, and adjusting the A/F ratio to to the actual driveability index of the fuel. As will be appreciated by those skilled in the art, the computer program need not reside in the engine control module 12 but could reside in a separate entity. Further, the computer program could be implemented by other means than a computer program, for instance an application specific integrated circuit (ASIC), and still be within the spirit and scope of the invention.

It will be appreciated by those skilled in the art that changes could be made to the embodiments described above without departing from the broad inventive concept thereof. For instance, the invention is not limited to vehicles but is equally applicable to the operation of any internal combustion engine which is not in continuous operation. It is understood, therefore, that this invention is not limited to the particular embodiments disclosed, but it is intended to cover modifications within the spirit and scope of the present invention as defined by the appended claims.

We claim:

1. A method for determining if the driveability index of a first fuel being consumed by an internal combustion engine differs from the driveability index of a second fuel for which an air-to-fuel ratio of the engine is preset, comprising the steps of:

determining a speed of the engine;

determining a load on the engine;

determining an actual exhaust gas temperature of the engine;

computing a predicted exhaust gas temperature based on the speed, the load and the preset air-to-fuel ratio of the engine;

and comparing the predicted exhaust gas temperature to the actual exhaust gas temperature to determine if the difference between the actual exhaust gas temperature and the predicted exhaust gas temperature exceeds a predetermined value.

2. A system for determining if the driveability index of a first fuel being consumed by an internal combustion engine differs from the driveability index of a second fuel for which an air-to-fuel ratio of the engine is preset, comprising:

a sensor for measuring a speed of the engine;

a sensor for measuring a load on the engine;

a sensor for measuring an actual exhaust gas temperature of the engine; and a controller including a look-up table having a value of a predicted exhaust gas temperature for each one of a plurality of values of the engine air-to-fuel ratio, the controller for receiving output signals from the speed sensor, the load sensor and the exhaust gas temperature sensor, computing the predicted exhaust gas temperature based on the sensed speed, the sensed load and the preset air-to-fuel ratio of the engine, and comparing the predicted exhaust gas temperature to the actual exhaust gas temperature to determine if the difference between the actual exhaust gas temperature and the predicted exhaust gas temperature exceeds a predetermined value.

3. The system according to claim 2, further including an exhaust gas temperature sensor interface device for enhancing the output signal of the exhaust gas temperature sensor to have a response time of less than one second.

4. A method for optimizing an air-to-fuel ratio of an internal combustion engine to achieve satisfactory driveability during a cold start period, when the engine is being supplied with a first fuel having an unknown driveability index, comprising the steps of:

presetting the air-to-fuel ratio of the engine to a predetermined value to achieve satisfactory driveability with a second fuel having a predetermined driveability index;

determining a speed of the engine;

determining a load of the engine;

determining an actual exhaust gas temperature of the engine;

computing a predicted exhaust gas temperature based upon the speed of the engine, the load of the engine, and the preset air-to-fuel ratio;

comparing the predicted exhaust gas temperature and the actual exhaust gas temperature; and correcting the preset air-to-fuel ratio in proportion to a difference between the predicted exhaust gas temperature and the actual exhaust gas temperature.

5. A method for optimizing the air-to-fuel ratio of an internal combustion engine according to claim 4 wherein the cold start period is determined from a measurement of a temperature of intake air of the engine and a temperature of coolant of the engine.

6. A method for optimizing the air-to-fuel ratio of an internal combustion engine according to claim 4 wherein the air-to-fuel ratio is initially preset to achieve satisfactory driveability with the second fuel having a standard driveability index.

7. A method for optimizing the air-to-fuel ratio of an internal combustion engine according to claim 6 wherein the air-to-fuel ratio is enriched when the actual exhaust gas temperature exceeds the predicted exhaust gas temperature by a predetermined value.

8. A method for optimizing the air-to-fuel ratio of an internal combustion engine according to claim 4 wherein the predicted exhaust gas temperature is computed by reading a value of exhaust gas temperature from one of a plurality of empirically derived numeric look-up tables based on the preset air-to-fuel ratio, each look-up table covering a predetermined range of the engine speed and the engine load.

9. A system for optimizing an air-fuel-ratio of an internal combustion engine during a cold start period when the engine is being supplied with a first fuel having an unknown driveability index comprising:

a sensor for measuring a speed of the engine;

a sensor for measuring a load of the engine;

a sensor for measuring an actual exhaust gas temperature of the engine; and a controller including a look-up table having a value of a predicted exhaust gas temperature for each one of a plurality of values of the engine air-to-fuel ratio, the controller for receiving output signals from the speed sensor, the load sensor and the exhaust gas temperature sensor, for predicting the exhaust gas temperature resulting from supplying the engine with a second fuel having a predetermined driveability index, the predicted exhaust gas temperature being based on the sensed speed, the sensed load, and a preset air-to-fuel ratio of the engine, for comparing the actual exhaust gas temperature with the predicted exhaust gas temperature and for providing an output signal to at least one actuator for correcting the preset air-to-fuel ratio in relation to a difference between the predicted exhaust gas temperature and the actual exhaust gas temperature.

10. The system according to claim 9 further including an engine coolant temperature sensor and an air charge temperature sensor whereby the outputs from the engine coolant sensor and the air charge sensor are received by the controller to determine if the engine is operating in the cold start period.

11. The system according to claim 9 further including an exhaust gas temperature sensor interface device for enhancing the output signal of the exhaust gas temperature sensor to have a response time of less than one second.

12. A method for reducing hydrocarbon emissions from an internal combustion engine during a cold start period, comprising the steps of:

determining if the internal combustion engine is cold;

predicting a temperature of an exhaust gas of the engine based on an air-to-fuel ratio of the engine, a speed of the engine and a load of the engine, the air-to-fuel ratio being selected for a fuel having a predetermined driveability index;

sensing an actual temperature of the exhaust gas;

comparing the predicted exhaust gas temperature with the actual exhaust gas temperature; and correcting the air-to-fuel ratio of the engine in proportion to the difference between the predicted exhaust gas temperature and the sensed exhaust gas temperature.

13. A method for reducing the hydrocarbon emissions of an internal combustion engine according to claim 12 further including a step of determining an engine coolant temperature and an intake air temperature wherein the engine is determined to be cold if the engine coolant temperature is less than a predetermined value and the intake air temperature is less than a predetermined value.

14. A method for reducing the hydrocarbon emissions of an internal combustion engine according to claim 12 wherein the exhaust gas temperature is predicted by reading a value of the exhaust gas temperature from one of a plurality of empirically derived numeric look-up tables based on the preset value of the air-to-fuel ratio, each look-up table covering a predetermined range of the engine speed and the engine load.

15. A computer executable software code stored on a computer readable medium, the code for reducing hydrocarbon emissions from an internal combustion engine during a cold start period, the software comprising:

code initially setting an air-to-fuel ratio of the engine to a preset value;

a look up table having a value of a predicted exhaust gas temperature for each one of a plurality of values of the engine air-to-fuel ratio, the controller wherein each look-up table covers a predetermined range of a sensed speed of the engine and a sensed load of the engine;

code responsive to receiving a value of the sensed engine load;

code responsive to receiving a value of the sensed engine speed;

code for selecting one of the look-up tables corresponding to the sensed engine speed and the sensed engine load;

code for receiving the preset air-to-fuel ratio in the selected look-up table and identifying a predicted exhaust gas temperature;

code responsive to receiving a value of a sensed exhaust gas temperature; and code for comparing the predicted exhaust gas temperature with the sensed exhaust gas temperature and for correcting the preset air-to-fuel ratio of the engine in proportion to the difference between the predicted exhaust gas temperature and the sensed exhaust gas temperature.

* * * * *